US012336615B2

(12) United States Patent
Yang

(10) Patent No.: US 12,336,615 B2
(45) Date of Patent: Jun. 24, 2025

(54) COSMETIC MATERIAL CARRIER AND CARTRIDGE CORE ASSEMBLY INCLUDING SAME

(71) Applicant: SHYA HSIN PACKAGING INDUSTRY (CHINA) CO., LTD., Kunshan (CN)

(72) Inventor: Haiying Yang, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 0 days.

(21) Appl. No.: 18/402,656

(22) Filed: Jan. 2, 2024

(65) Prior Publication Data

US 2024/0358140 A1 Oct. 31, 2024

(30) Foreign Application Priority Data

Apr. 27, 2023 (CN) ..... 202310470912.4

(51) Int. Cl.

| | |
|---|---|
| ***A45D 40/04*** | (2006.01) |
| ***A45D 40/02*** | (2006.01) |
| ***A45D 40/06*** | (2006.01) |
| *A45D 40/00* | (2006.01) |

(52) U.S. Cl.

CPC ..... *A45D 40/04* (2013.01); *A45D 40/02* (2013.01); *A45D 40/023* (2013.01); *A45D 40/06* (2013.01); *A45D 40/065* (2013.01); *A45D 2040/0062* (2013.01); *A45D 2200/05* (2013.01)

(58) Field of Classification Search

CPC ..... A45D 40/02; A45D 40/023; A45D 40/04; A45D 40/06; A45D 40/065; A45D 2040/0062

USPC ..... 401/78, 86, 87

See application file for complete search history.

(56) References Cited

U.S. PATENT DOCUMENTS

| | | | | | |
|---|---|---|---|---|---|
| 2,332,147 | A * | 10/1943 | Holihan | A45D 40/06 | 401/74 |
| 2,469,631 | A * | 5/1949 | Felstiner | A45D 40/06 | 401/78 |
| 5,860,756 | A * | 1/1999 | Fabrisi | A45D 40/06 | 401/78 |
| 6,116,801 | A * | 9/2000 | Patel | A45D 40/06 | 401/78 |

* cited by examiner

*Primary Examiner* — Jennifer C Chiang

(74) *Attorney, Agent, or Firm* — Bayramoglu Law Offices LLC

(57) ABSTRACT

A cosmetic material carrier and a cartridge core assembly including same are provided. The cosmetic material carrier includes a tube body and a bottom plate fixedly connected to the tube body, where a lug protruding outward along a radial direction is provided on a sidewall of the tube body, and a tab for fixing a cosmetic material is provided on the bottom plate. The lug connected to a spiral portion is provided on the tube body. The tab for fixing a paste is provided on the bottom plate. The cosmetic material carrier is an integrated tube. Therefore, a manufacturing process and a mounting process are simplified, and a manufacturing cost of the carrier is lowered.

12 Claims, 19 Drawing Sheets

COSMETIC MATERIAL CARRIER AND CARTRIDGE CORE ASSEMBLY INCLUDING SAME

CROSS REFERENCE TO THE RELATED APPLICATIONS

This application is based upon and claims priority to Chinese Patent Application No. 202310470912.4, filed on Apr. 27, 2023, the entire contents of which are incorporated herein by reference.

TECHNICAL FIELD

The present invention relates to a cosmetic packaging technology, and in particular to a carrier for a lipstick product and a cartridge core assembly including same.

BACKGROUND

As a main component of a tube container, a cartridge core includes a threaded rod, a movable cylindrical portion, and a rotatable cylindrical portion. The movable cylindrical portion is configured to carry a cosmetic material. The rotation of a nut drives the movable cylindrical portion to move back and forth along the rotatable cylindrical portion, thereby realizing extension and retraction of the cosmetic material. There are integrated movable cylindrical portions and two-piece movable cylindrical portions at present. A two-piece movable cylindrical portion includes an inner barrel and an outer barrel. The inner barrel is configured to carry and fix a cosmetic material. The outer barrel is connected to a rotatable cylindrical portion to define a moving path of the movable cylindrical portion. The two-piece movable cylindrical portion has a complex structure, a cumbersome assembly process, and a high manufacturing cost. Concerning the traditional integrated movable cylindrical portion, both a tab and a lug are provided on a tube body. Consequently, the tab and the lug are limited in shape, and a coaxiality of the tube body is difficult to control.

SUMMARY

The present invention provides a cosmetic material carrier to overcome the above defects. The carrier includes a tube body and a bottom plate. A lug connected to a spiral portion is provided on the tube body. A tab for fixing a paste is provided on the bottom plate. The cosmetic material carrier is an integrated tube. The present invention simplifies a manufacturing process and a mounting process, and lowers a manufacturing cost of the carrier.

To solve the technical problems, the present invention employs the following technical solutions.

A cosmetic material carrier includes a tube body and a bottom plate fixedly connected to the tube body, where a lug protruding outward along a radial direction is provided on a sidewall of the tube body, and a tab for fixing a cosmetic material is provided on the bottom plate.

Optionally, the tube body includes an upper open end and a lower open end, and the bottom plate is fixedly provided at the lower open end, or the bottom plate is fixedly provided in the tube body between the upper open end and the lower open end.

Optionally, the tab includes a first end and a second end, where the first end of the tab is connected to the bottom plate, the second end of the tab is a free end, and the second end of the tab extends toward the upper open end and/or the lower open end.

Optionally, a first end of the tab is narrower than a second end of the tab.

Optionally, the tab is inclined relative to an axial center of the tube body.

Optionally, the second end of the tab forms a bending portion toward the sidewall of the tube body or toward the axial center of the tube body.

Optionally, the tab is formed by bending after punching and cutting the bottom plate.

Optionally, a punched hole is formed by punching and cutting the bottom plate, and the tab is formed at an edge of the punched hole.

Optionally, M tabs are provided on the bottom plate, and a distance between two adjacent tabs is identical, where $M \geq 1$, and M is an odd number; or, N pairs of tabs are provided on the bottom plate, and each pair of tabs are arranged symmetrically along the axial center of the tube body, where $N \geq 1$, and N is an integer.

Optionally, the carrier is an integrally formed metal piece, and the lug is formed by punching the sidewall of the tube body outward along the radial direction.

The present invention further provides a cartridge core assembly, including the carrier, a rotatable cylindrical portion, and a spiral portion, where the spiral portion is sleeved on the rotatable cylindrical portion, the rotatable cylindrical portion is sleeved on the carrier, a screw thread is provided on an inner side of the spiral portion, a guide groove is formed in the rotatable cylindrical portion along an axial direction, the lug passes through the guide groove and cooperates with the screw thread, and when rotating relative to the rotatable cylindrical portion, the spiral portion can drive the carrier to move along the axial direction.

The present invention has the following beneficial effects: The carrier is an integrated piece. The carrier includes a tube body and a bottom plate. A lug connected to a spiral portion is provided on the tube body. A tab for fixing a paste is provided on the bottom plate. That is, both the lug and the tabs are provided on the carrier. Compared with a traditional two-piece movable cylindrical portion assembly, the present invention simplifies a manufacturing process and a mounting process, reduces a production process, and lowers a production cost of the carrier. The lug is provided on the tube body. The tab is provided on the bottom plate. The tab and the lug can be machined into any shape. The present invention solves problems of limited shapes of the tab and the lug and difficult control on a coaxiality of the tube body due to a fact that both the tab and the lug are provided on the tube body.

In the figures: 100—carrier, 110—tube body, 111—lug, 120—bottom plate, 121—tab, 122—bending portion, 123—punched hole, 200—rotatable cylindrical portion, 201—guide groove, 202—positioning groove, and 300—spiral portion.

DETAILED DESCRIPTION OF THE EMBODIMENTS

The technical solutions in the embodiments of the present invention are clearly and completely described below with reference to the embodiments of the present invention. Apparently, the described embodiments are merely some rather than all of the embodiments of the present invention. All other embodiments obtained by a person of ordinary skill in the art based on the embodiments of the present invention without creative efforts shall fall within the protection scope of the present invention.

It should be noted that the terms "first", "second", and so on in the description and claims of this application and in the above accompanying drawings are intended to distinguish similar objects but do not necessarily indicate a specific order or sequence. It should be understood that the objects used in such a way may be exchanged under proper conditions to make it possible to implement the described implementations of this application in sequences except those illustrated or described herein. Moreover, the terms "include", "have" and their variants mean to cover a non-exclusive inclusion. For example, a process, method, system, product or device that includes a list of steps or units is not necessarily limited to those steps or units which are clearly listed. Instead, they may include other steps or units which are not expressly listed or inherent to such a process, method, product, or device.

For ease of description, spatially relative terms, such as "above", "on the upper side of", "on the upper surface of" and "on", can be used to describe the spatial positional relationship between components or features shown in the figure. It should be understood that the spatially relative terms are intended to encompass different orientations of the components in use or operation in addition to those shown in the figure. For example, if a component in the figure is inverted, it is described as a component "above other component or structure" or "on other component or structure". Therefore, the component will be positioned as "below other component or structure" or "under other component or structure". Therefore, the exemplary term "above" may include both orientations "above" and "below". The component may also be positioned in other different ways (rotated by 90 degrees or in other orientations), but the relative description of the space should be explained accordingly.

Figure 1:
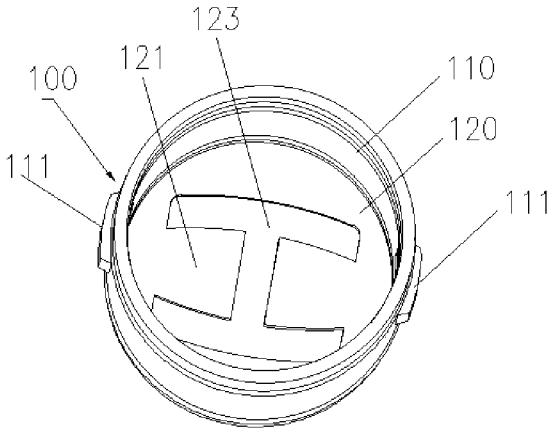
FIG. 1 is a first schematic structural view of a carrier upon punching according to Embodiment 1 of the present invention.
Figure 2:
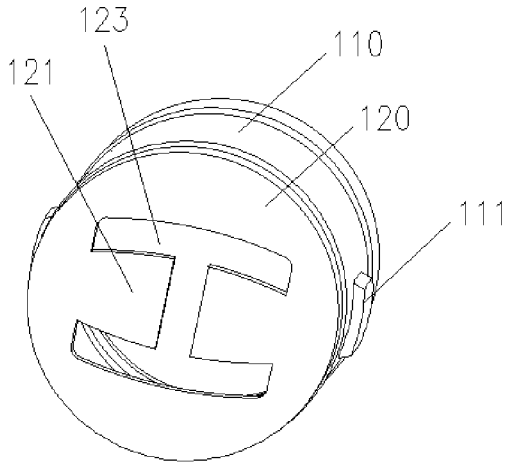
FIG. 2 is a second schematic structural view of a carrier upon punching according to Embodiment 1 of the present invention.
Figure 3:
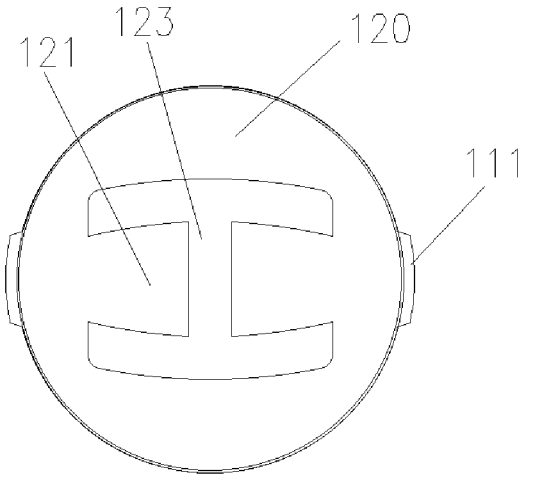
FIG. 3 is a bottom view of a carrier upon punching according to Embodiment 1 of the present invention.
Figure 4:
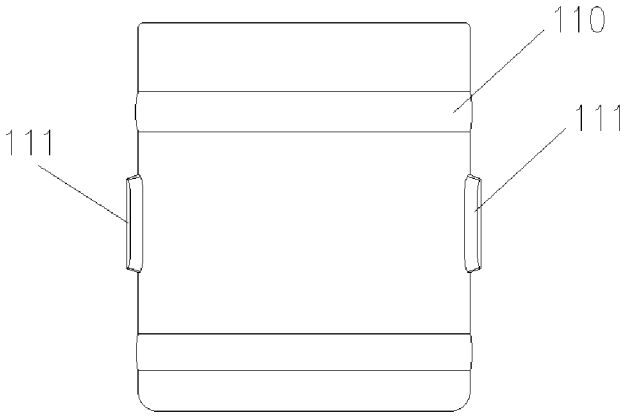
FIG. 4 is a front view of a carrier upon punching according to Embodiment 1 of the present invention.
Figure 5:
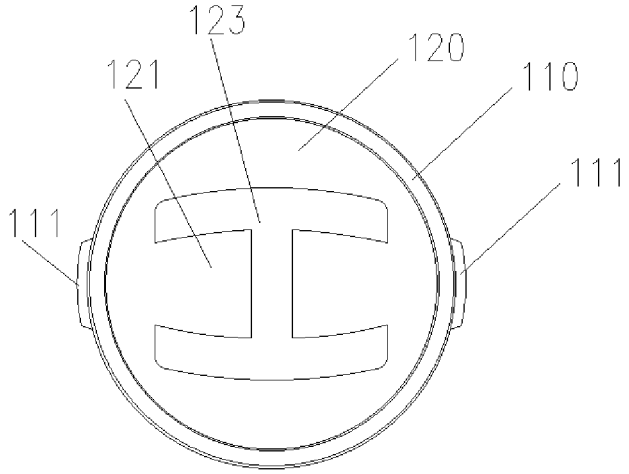
FIG. 5 is a top view of a carrier upon punching according to Embodiment 1 of the present invention.
Figure 52:
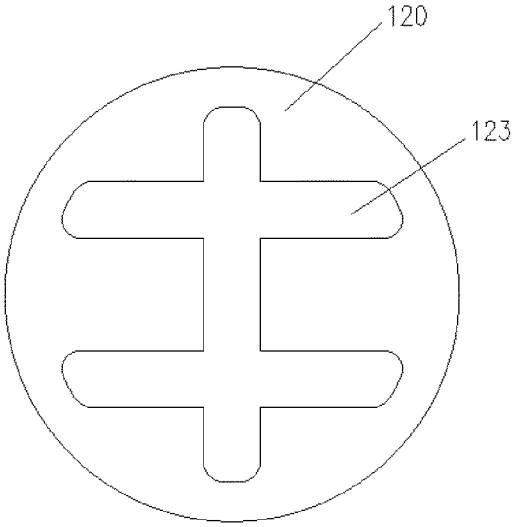
FIG. 52 illustrates a shape of a punched hole according to Embodiment 4 of the present invention.

As shown in FIGS. 1-52, a cosmetic material carrier includes tube body 110 and bottom plate 120 fixedly connected to the tube body 110. Lug 111 protruding outward along a radial direction is provided on a sidewall of the tube body 110. Tab 121 for fixing a cosmetic material is provided on the bottom plate 120. The carrier 100 is configured to carry a cosmetic material, and is particularly suitable for a pasty cosmetic material, such as a lipstick, a lippie, a lip gloss, a deodorant balm and a deodorant cream. In response to filling, the cosmetic material, namely a paste, is injected into the tube body 110. The bottom plate 120 is configured to support the cosmetic material. The tab 121 on the bottom plate 120 is configured to fix the paste, prevent separation of the paste from the carrier, and prevent the paste from shaking to affect a makeup effect in use. The lug 111 on the tube body 110 cooperates with a rotatable cylindrical portion to define a moving path of the carrier 100. The carrier 100 provided by the present invention is an integrated piece. The lug 111 and the tab 121 are provided on the carrier 100. Compared with a traditional two-piece movable cylindrical portion, the present invention simplifies a manufacturing process and a mounting process, and lowers a lower production cost of the carrier 100. The lug is provided on the tube body 110. The tab 121 is provided on the bottom plate 120. The tab and the lug can be machined into any shape. The present invention solves problems of limited shapes of the tab and the lug and difficult control on a coaxiality of the tube body due to a fact that both the tab and the lug are provided on the tube body in the traditional integrated movable cylindrical portion. The coaxiality refers to an axial deviation between centers of unit circles in a cylindrical piece.

The tube body 110 includes an upper open end and a lower open end. The tube body 110 is a cylindrical structure that is open up and down and is internally hollow. In response to the filling, the paste is injected into the tube body 110 through the upper open end. In an implementation, as shown in FIGS. 1-12, the bottom plate 120 is fixedly provided at the lower open end. That is, the carrier is a hollow cylindrical structure with a lower end provided with the bottom plate 120, and an upper end being an open end. In another implementation, the bottom plate 120 is fixedly provided in the tube body 110 between the upper open end and the lower open end. Not shown in the figures, both the upper end and the lower end of the carrier are open ends, the bottom plate 120 is provided at a middle of the tube body 110 along an axial direction, and the bottom plate 120 is close to the lower open end of the tube body 110.

Figure 7:
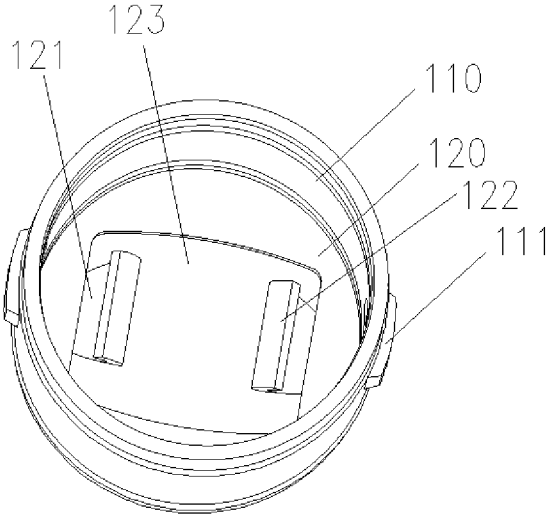
FIG. 7 is a first schematic structural view of a carrier upon bending according to Embodiment 1 of the present invention.
Figure 8:
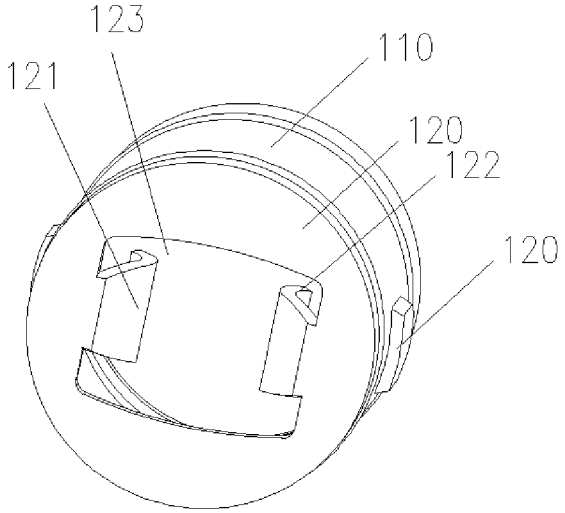
FIG. 8 is a second schematic structural view of a carrier upon bending according to Embodiment 1 of the present invention.
Figure 9:
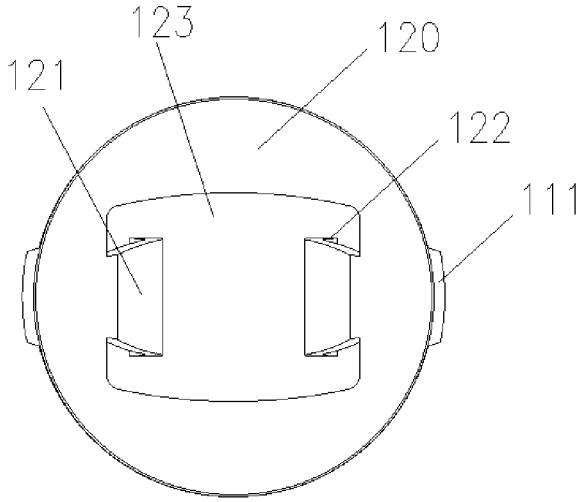
FIG. 9 is a bottom view of a carrier upon bending according to Embodiment 1 of the present invention.
Figure 10:
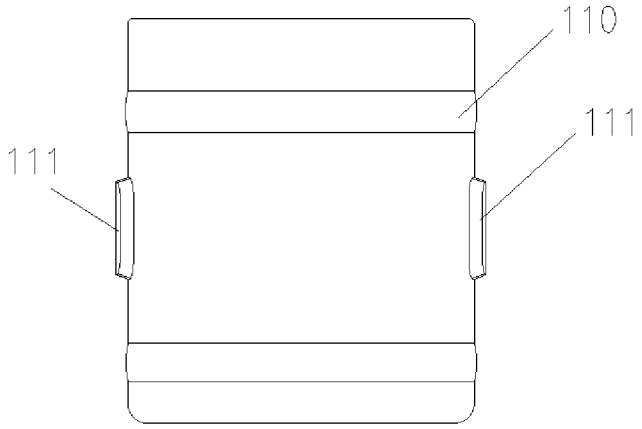
FIG. 10 is a front view of a carrier upon bending according to Embodiment 1 of the present invention.

As shown in FIGS. 7-9, the tab 121 includes a first end and a second end. The first end of the tab 121 is connected to the bottom plate 120. The second end of the tab 121 is a free end. The second end of the tab 121 extends toward the upper open end and/or the lower open end. The second end of the tab 121 extends toward the upper open end and/or the lower open end, which at least includes the following solutions: In a first solution, when the bottom plate 120 is sealed at the lower open end, the second end of the tab 121 extends toward the upper open end. In a second solution, when the bottom plate 120 is located at the middle of the tube body 110, the second end of the tab 121 extends toward the upper open end. In a third solution, when the bottom plate 120 is located at the middle of the tube body 110, the second end of the tab 121 extends toward the lower open end. In a fourth solution, when the bottom plate 120 is located at the middle of the tube body 110, the second end of a part of the tab 121 extends toward the upper open end, and the second end of a part of the tab 121 extends toward the lower open end.

As shown in FIG. 1, a first end of the tab 121 is narrower than a second end of the tab 121. That is, a junction between the tab 121 and the bottom plate 120 is narrower than the free end of the tab 121. Optionally, the tab 121 is of a trapezoid-like structure.

The tab 121 may be provided along the axial direction of the tube body 110, and may also be inclined. Optionally, as shown in FIGS. 7-9, the tab 121 is inclined relative to an axial center of the tube body 110. That is, an included angle between the tab 121 and the bottom plate 120 is not a right angle. Optionally, the included angle between the tab 121 and the bottom plate 120 is an acute angle.

As shown in FIG. 8, the second end of the tab 121 forms bending portion 122 toward the sidewall of the tube body 110 or toward the axial center of the tube body 110. The tab 121 is inclined on the bottom plate 120, the first end of the tab 121 is narrower than the second end of the tab, and the second end of the tab 121 is provided with the bending portion 122. This further improves a strength of the tab for fixing the paste.

In an implementation, the tab 121 is fixed on an inner surface of the bottom plate 120. The tab 121 protrudes from the inner surface of the bottom plate 120. In the embodiment, the lower end of the tube body 110 is sealed by the bottom plate 120. The bottom plate 120 includes an inner surface and an outer surface opposite to each other. The tab 121 protrudes from the inner surface of the bottom plate 120. The tab 121 serves as an additional component relative to the bottom plate 120, namely the bottom plate 120 is not damaged in formation of the tab 121. The paste is carried on the inner surface of the bottom plate 120. The tab 121 on the inner surface is inserted into the paste, thereby fixing the paste.

To simplify a machining process, the tab 121 is formed by deformation of the bottom plate 120. Optionally, the tab 121 is formed by bending after punching and cutting the bottom plate 120. That is, an area is cut on the bottom plate 120. A part of an edge of the area is separated from the bottom plate. Thereafter, the area is bent along an edge connected to the bottom plate 120 toward the upper open end or the lower open end of the tube body 110, thereby forming the tab 121. During cutting, a gap may be directly cut on the bottom plate 120, or punched hole 123 is formed by cutting on the bottom plate 120.

Optionally, as shown in FIGS. 1-12, punched hole 123 is formed by punching and cutting the bottom plate 120. The tab 121 is formed at an edge of the punched hole 123. That is, during cutting, punched holes 123 of different shapes are formed in the bottom plate 120. The tab 121 is formed in formation of the punched hole 123. The tab 121 is then bent toward the upper open end or the lower open end of the tube body 110. Optionally, the tab 121 is usually provided at an edge of a recessed portion of the punched hole 123.

A number of the tabs 121 is not defined. There may be one, two or more tabs 121. Optionally, in an implementation, M tabs 121 are provided on the bottom plate 120, and a distance between two adjacent tabs 121 is identical, where $M \geq 1$, and M is an odd number. The distance between the two adjacent tabs 121 refers to a distance between two adjacent center points at junctions between the tabs 121 and the bottom plate 120. In the embodiment, the odd number of the tabs 121 are provided on the bottom plate 120. The tabs 121 are uniformly distributed in a circumferential direction of the bottom plate 120, so as to improve a paste grasping capacity of the carrier. In another implementation, N pairs of tabs 121 are provided on the bottom plate 120. Each pair of tabs 121 are arranged symmetrically along the axial center of the tube body 110, where $N \geq 1$, and N is an integer. In the embodiment, at least one pair of axisymmetric tabs 121 are provided on the bottom plate 120 to improve a paste grasping capacity of the carrier. A shape of the punched hole 123 is not defined, and may be a pattern, a character, a figure, an irregular pattern, etc. Optionally, the punched hole 123 is of a hollow concave shape, an I shape, a crisscross shape, a shape formed by connecting three crisscross shapes, a well shape, an S shape, a C shape, an H shape or a Z shape.

Figure 12:
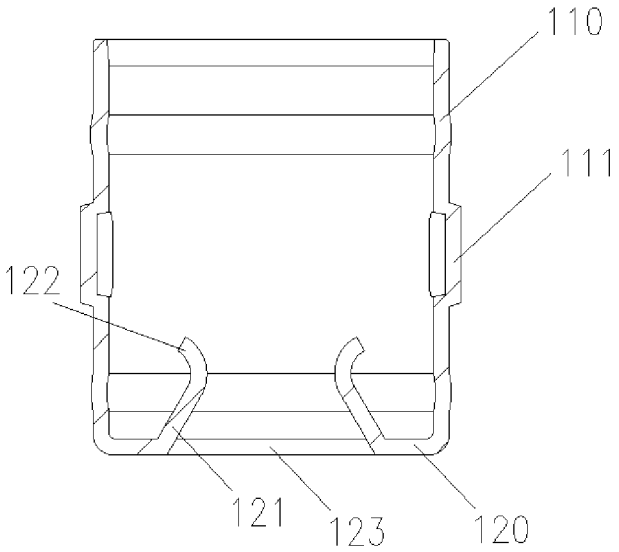
FIG. 12 is a sectional view of a carrier upon bending according to Embodiment 1 of the present invention.

The carrier 100 is an integrally formed metal piece. Optionally, the carrier 100 is an aluminum piece, a copper piece, an iron piece, etc. The lug 111 is formed by deformation of the bottom plate 120. Optionally, as shown in FIG. 12, the lug 111 is formed by punching the sidewall of the tube body 110 along the radial direction.

Figure 6:
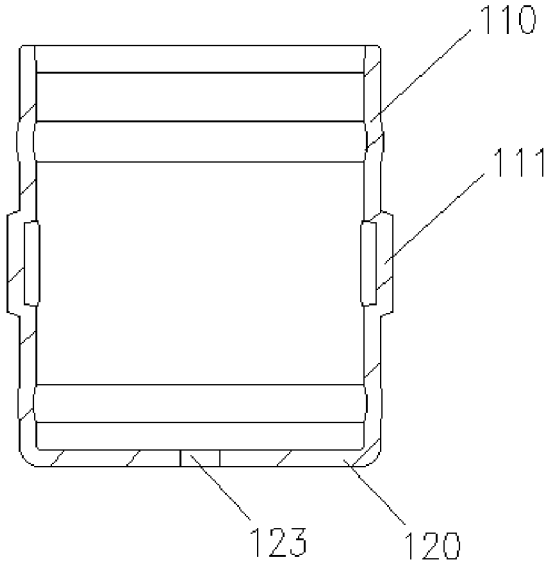
FIG. 6 is a sectional view of a carrier upon punching according to Embodiment 1 of the present invention.

Embodiment 1: The carrier 100 is made of an aluminum sheet material. As shown in FIG. 6, the lower open end of the tube body 110 is sealed by the bottom plate 120. Two sidewalls of the tube body 110 are respectively punched to form the lug 111. The punched hole 123 and the tab 121 are formed by punching and cutting the bottom plate 120. As shown in FIG. 12, the tab 121 is bent toward the upper open end. The tab 121 is inclined on the bottom plate 120. The second end of the tab 121 is bent toward the sidewall of the tube body 110 to form the bending portion 122, thereby improving the paste grasping strength of the tab 121.

Figure 11:
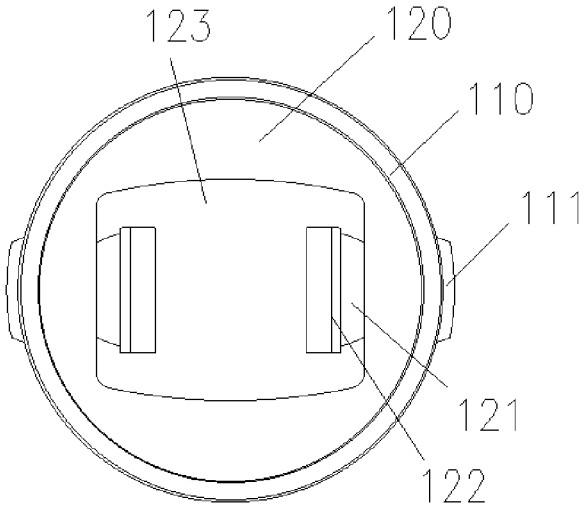
FIG. 11 is a top view of a carrier upon bending according to Embodiment 1 of the present invention.
Figure 13:
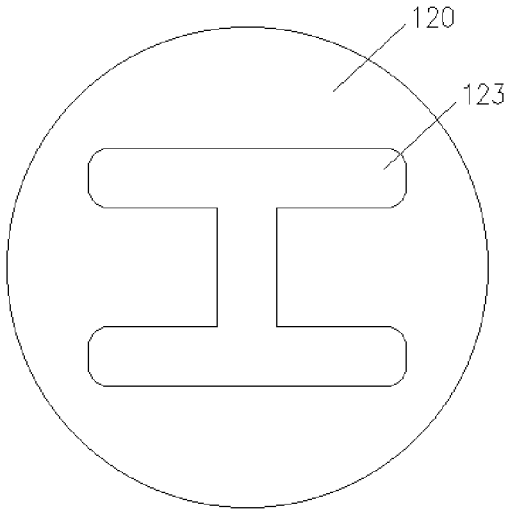
FIG. 13 illustrates a shape of a punched hole according to Embodiment 1 of the present invention.
Figure 14:
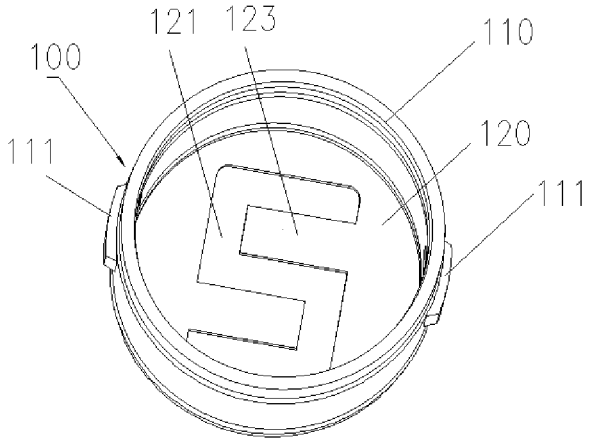
FIG. 14 is a first schematic structural view of a carrier upon punching according to Embodiment 2 of the present invention.
Figure 15:
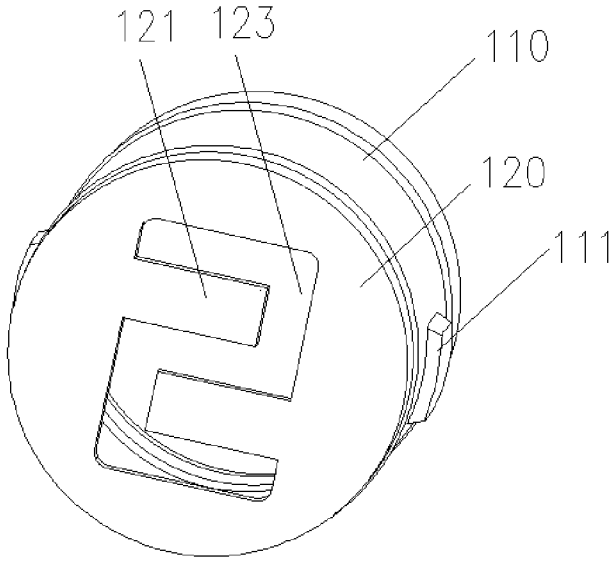
FIG. 15 is a second schematic structural view of a carrier upon punching according to Embodiment 2 of the present invention.
Figure 16:
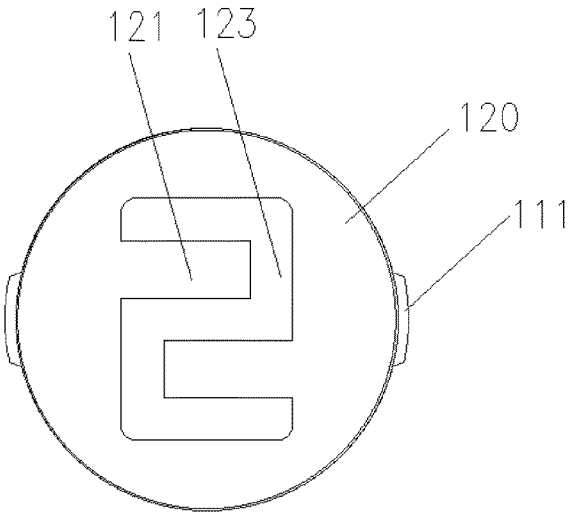
FIG. 16 is a bottom view of a carrier upon punching according to Embodiment 2 of the present invention.
Figure 17:
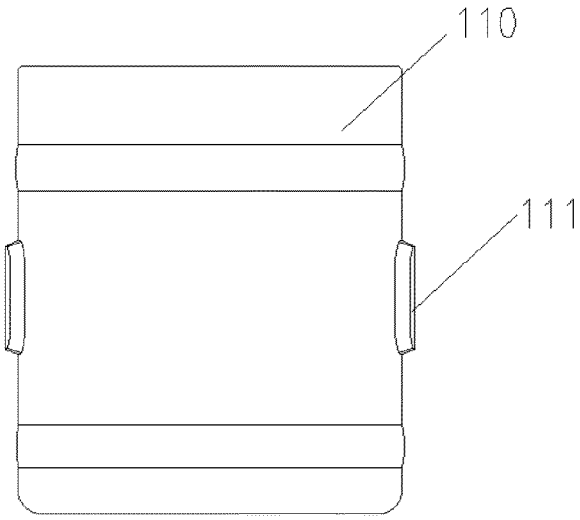
FIG. 17 is a front view of a carrier upon punching according to Embodiment 2 of the present invention.
Figure 18:
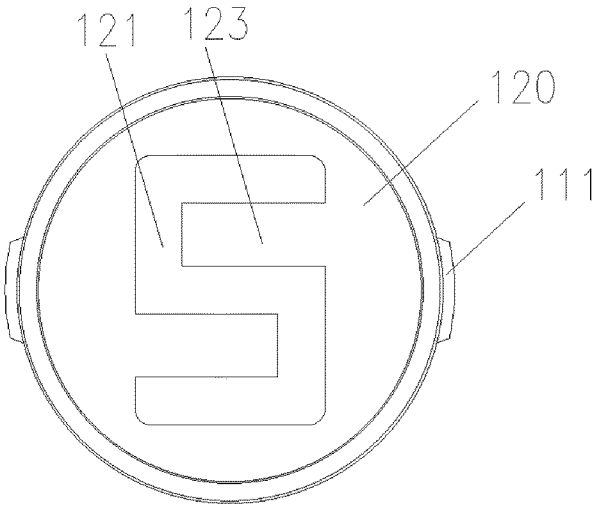
FIG. 18 is a top view of a carrier upon punching according to Embodiment 2 of the present invention.
Figure 19:
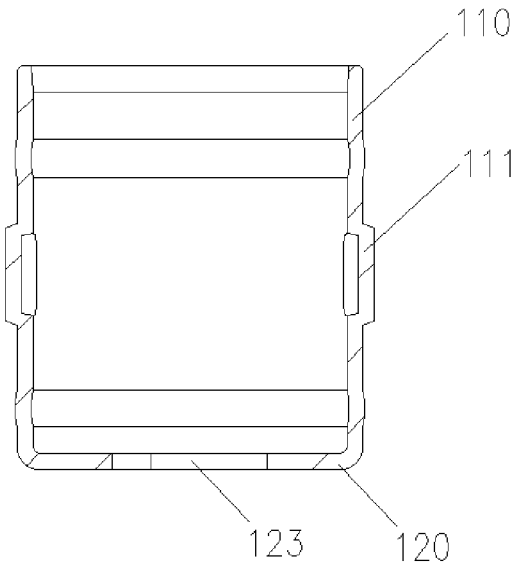
FIG. 19 is a sectional view of a carrier upon punching according to Embodiment 2 of the present invention.
Figure 20:
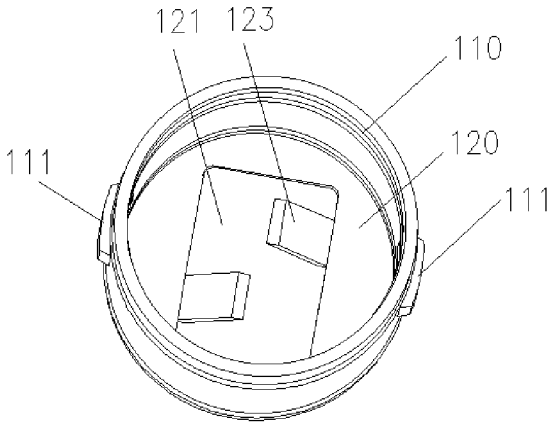
FIG. 20 is a first schematic structural view of a carrier upon bending according to Embodiment 2 of the present invention.
Figure 21:
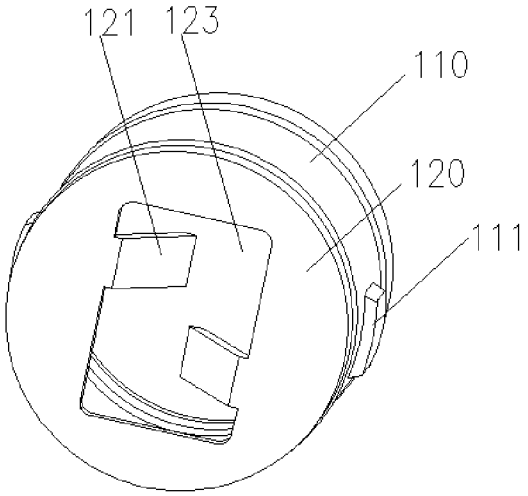
FIG. 21 is a second schematic structural view of a carrier upon bending according to Embodiment 2 of the present invention.
Figure 22:
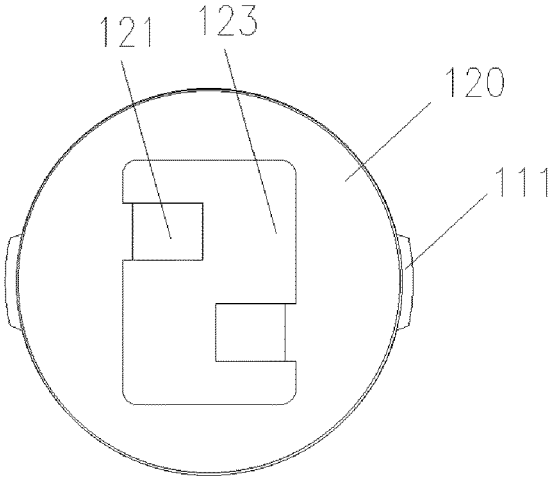
FIG. 22 is a bottom view of a carrier upon bending according to Embodiment 2 of the present invention.
Figure 23:
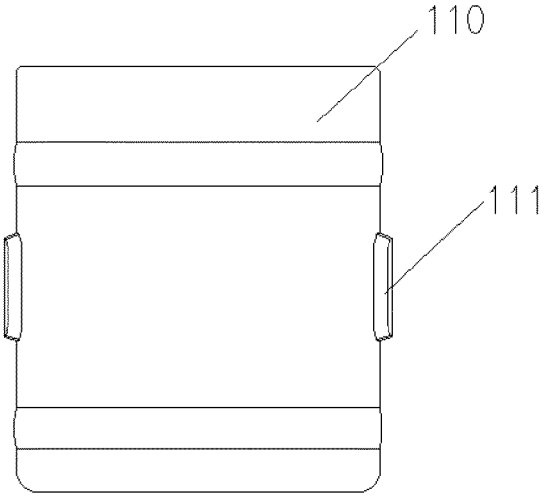
FIG. 23 is a front view of a carrier upon bending according to Embodiment 2 of the present invention.

As shown in FIG. 13, the punched hole 123 is of a hollow I shape in the embodiment. FIGS. 1-6 are a schematic view of the carrier upon punching in the embodiment. FIGS. 7-12 are a schematic view of the carrier after the tab 121 is bent in the embodiment. In the embodiment, as shown in FIG. 11, one pair of axisymmetric tabs 121 are provided on the bottom plate 120.

Figure 24:
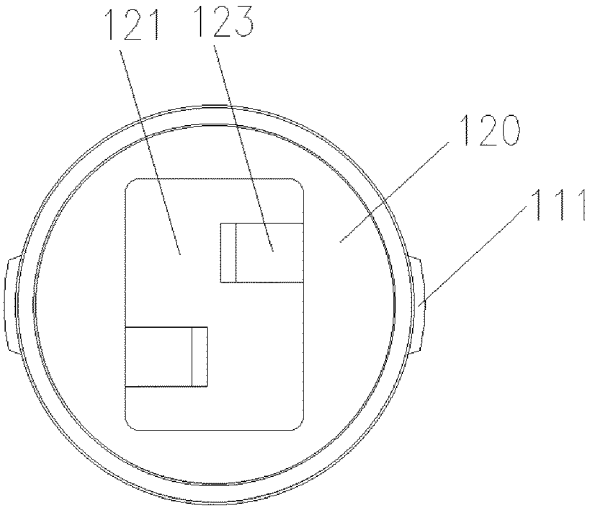
FIG. 24 is a top view of a carrier upon bending according to Embodiment 2 of the present invention.
Figure 25:
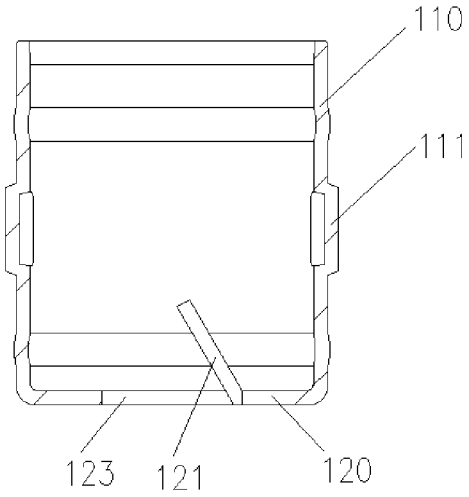
FIG. 25 is a sectional view of a carrier upon bending according to Embodiment 2 of the present invention.
Figure 26:
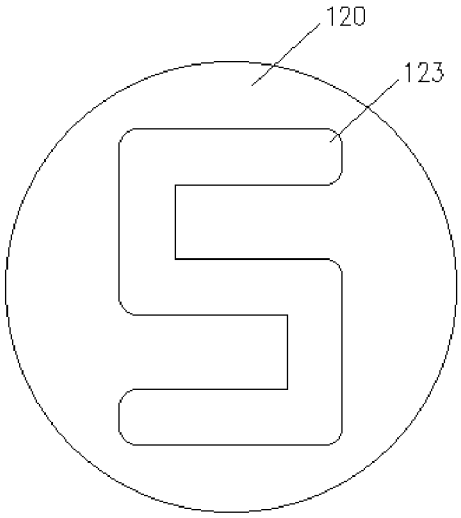
FIG. 26 illustrates a shape of a punched hole according to Embodiment 2 of the present invention.
Figure 27:
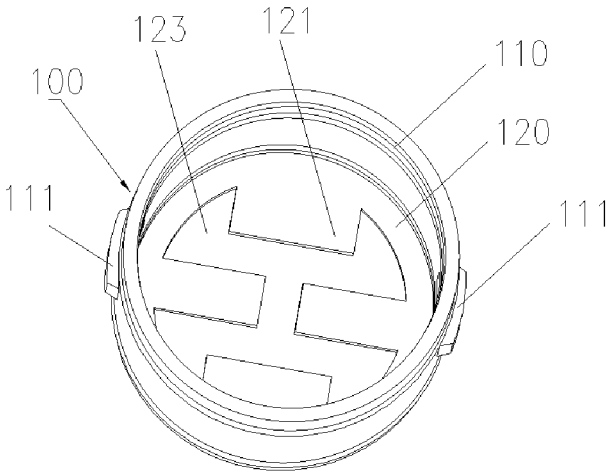
FIG. 27 is a first schematic structural view of a carrier upon punching according to Embodiment 3 of the present invention.
Figure 28:
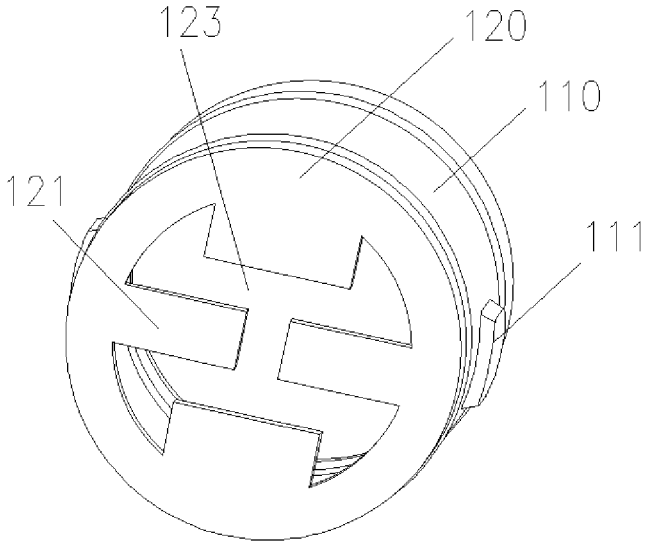
FIG. 28 is a second schematic structural view of a carrier upon punching according to Embodiment 3 of the present invention.
Figure 29:
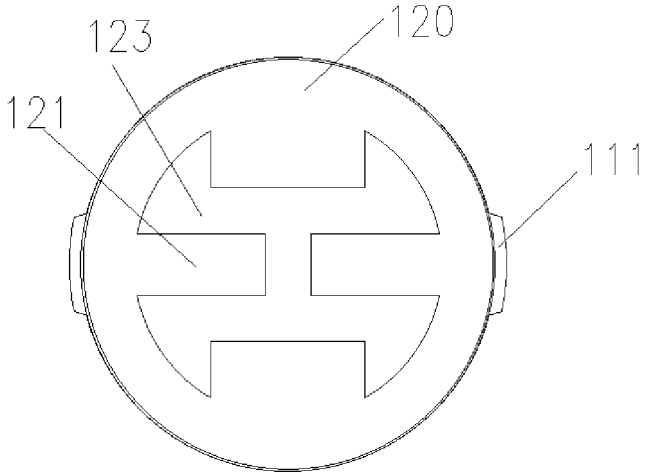
FIG. 29 is a bottom view of a carrier upon punching according to Embodiment 3 of the present invention.
Figure 30:
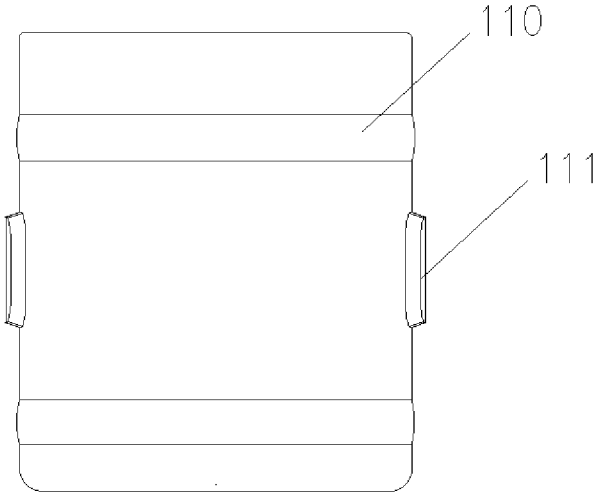
FIG. 30 is a front view of a carrier upon punching according to Embodiment 3 of the present invention.
Figure 31:
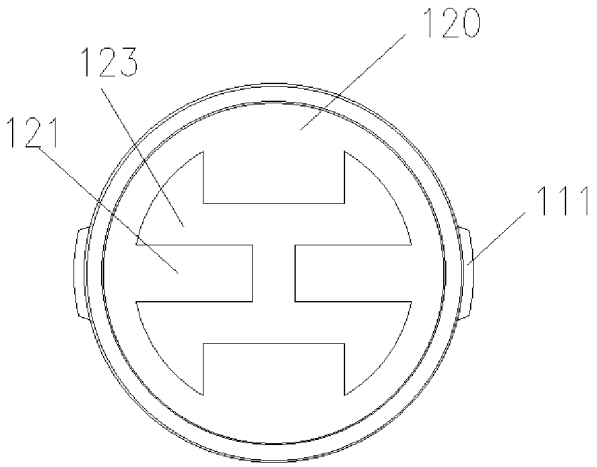
FIG. 31 is a top view of a carrier upon punching according to Embodiment 3 of the present invention.
Figure 32:
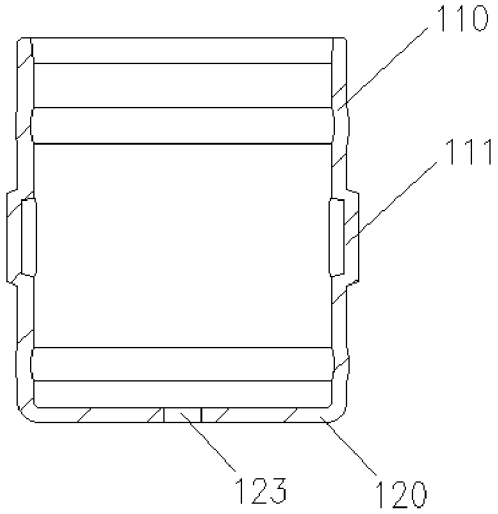
FIG. 32 is a sectional view of a carrier upon punching according to Embodiment 3 of the present invention.
Figure 33:
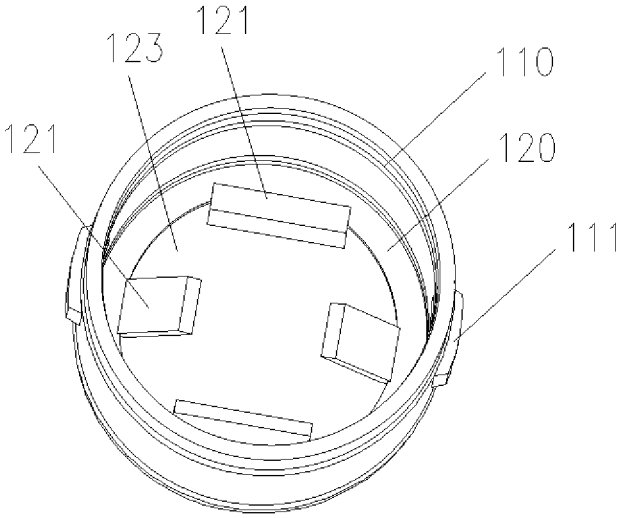
FIG. 33 is a first schematic structural view of a carrier upon bending according to Embodiment 3 of the present invention.
Figure 34:
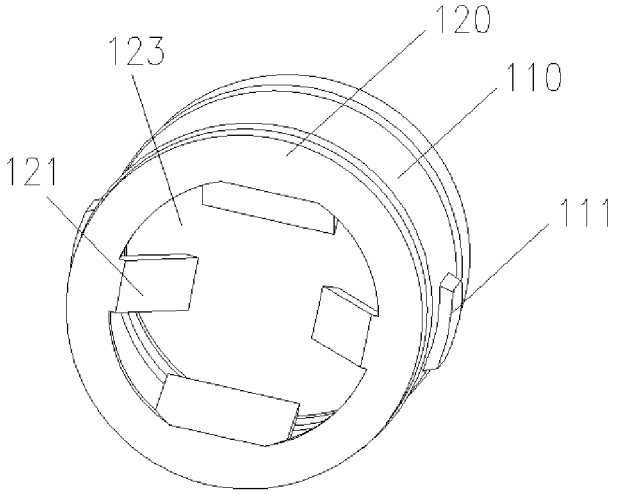
FIG. 34 is a second schematic structural view of a carrier upon bending according to Embodiment 3 of the present invention.
Figure 35:
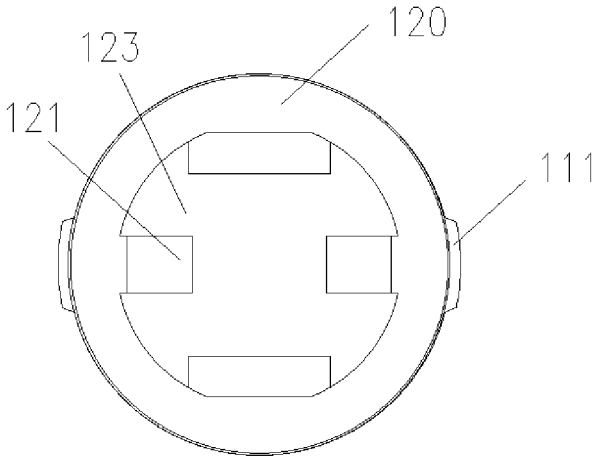
FIG. 35 is a bottom view of a carrier upon bending according to Embodiment 3 of the present invention.
Figure 36:
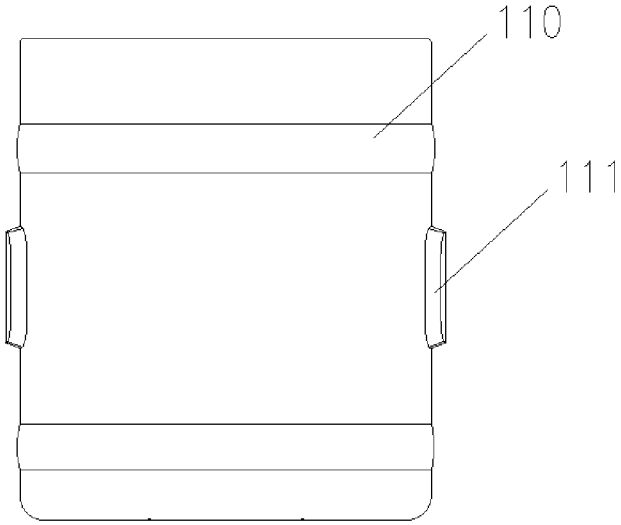
FIG. 36 is a front view of a carrier upon bending according to Embodiment 3 of the present invention.

Embodiment 2: The embodiment differs from Embodiment 1 in a shape of the punched hole. As shown in FIG. 26, the punched hole 123 is of a hollow S shape. FIGS. 14-19 are a schematic view of the carrier upon punching in the embodiment. FIGS. 20-25 are a schematic view of the carrier after the tab 121 is bent in the embodiment. In the embodiment, as shown in FIG. 24, one pair of axisymmetric tabs 121 are provided on the bottom plate 120.

Figure 37:
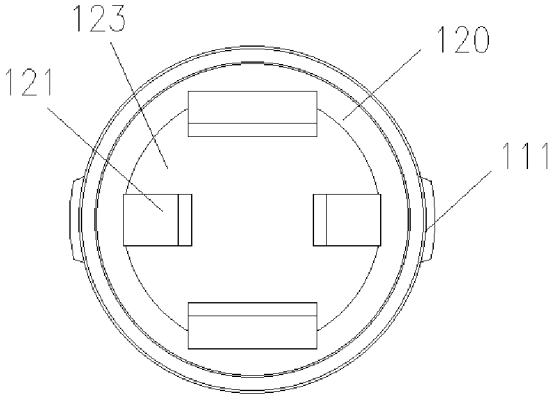
FIG. 37 is a top view of a carrier upon bending according to Embodiment 3 of the present invention.
Figure 38:
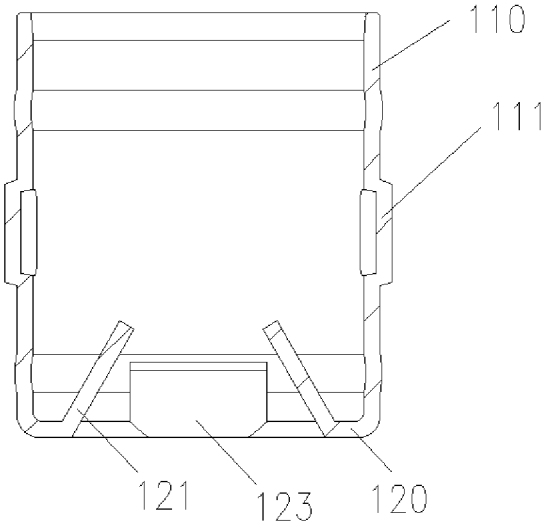
FIG. 38 is a sectional view of a carrier upon bending according to Embodiment 3 of the present invention.
Figure 39:
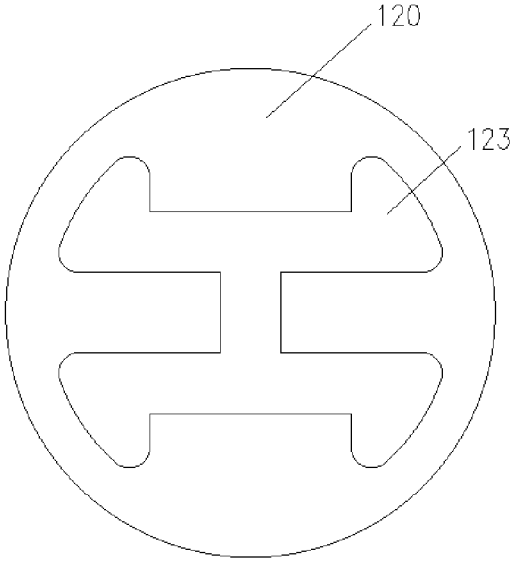
FIG. 39 illustrates a shape of a punched hole according to Embodiment 3 of the present invention.
Figure 40:
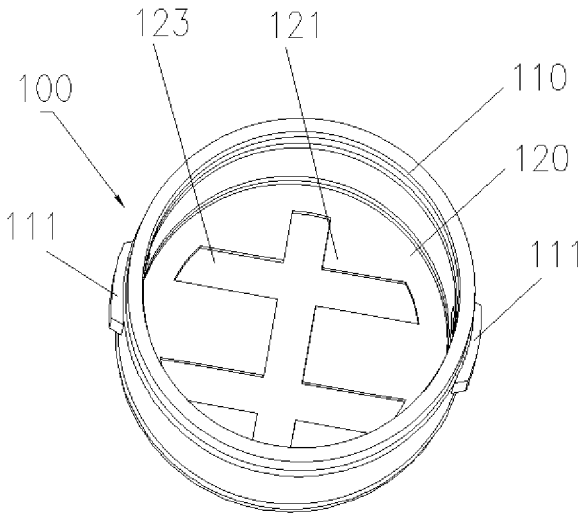
FIG. 40 is a first schematic structural view of a carrier upon punching according to Embodiment 4 of the present invention.
Figure 41:
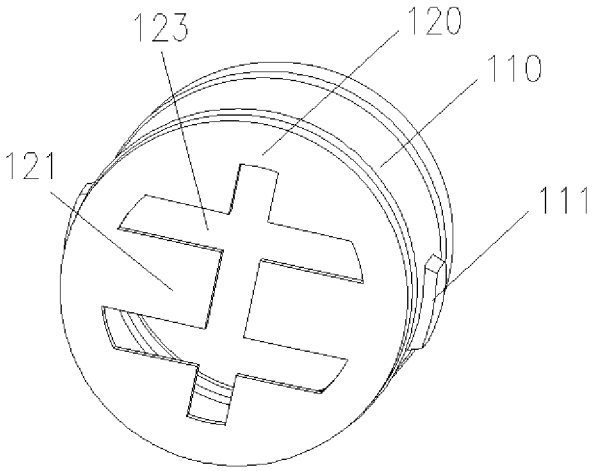
FIG. 41 is a second schematic structural view of a carrier upon punching according to Embodiment 4 of the present invention.
Figure 42:
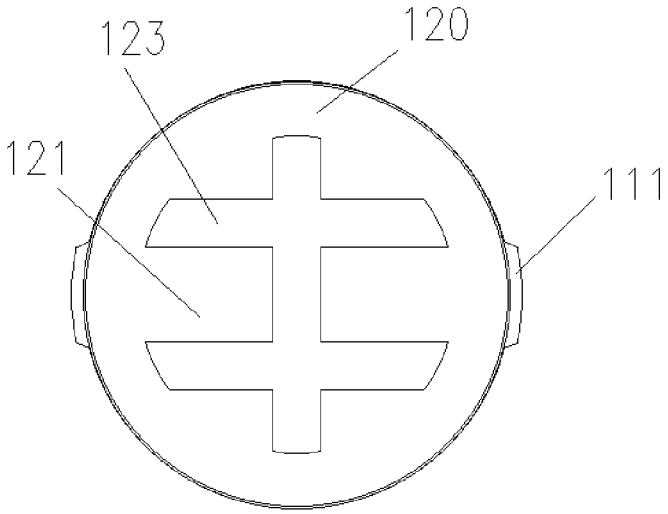
FIG. 42 is a bottom view of a carrier upon punching according to Embodiment 4 of the present invention.
Figure 43:
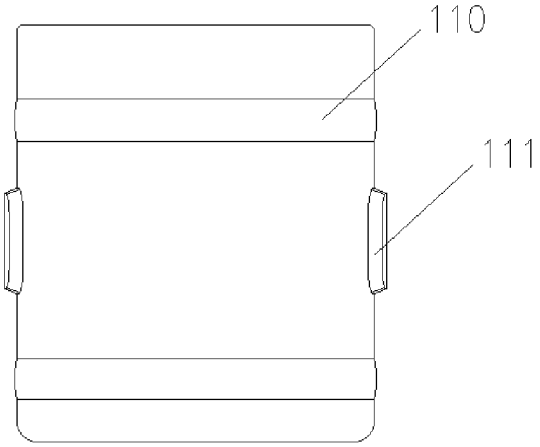
FIG. 43 is a front view of a carrier upon punching according to Embodiment 4 of the present invention.
Figure 44:
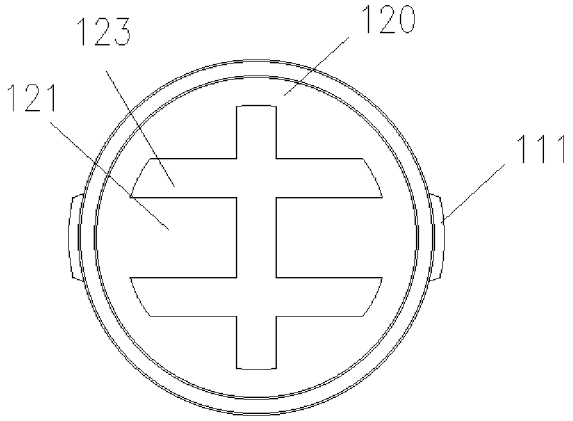
FIG. 44 is a top view of a carrier upon punching according to Embodiment 4 of the present invention.
Figure 45:
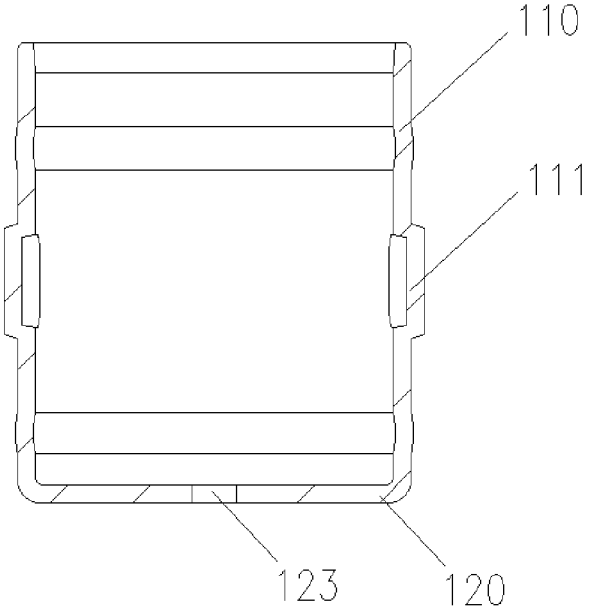
FIG. 45 is a sectional view of a carrier upon punching according to Embodiment 4 of the present invention.
Figure 46:
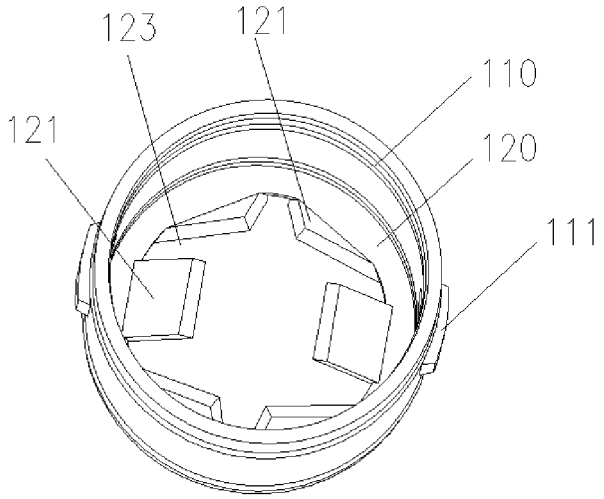
FIG. 46 is a first schematic structural view of a carrier upon bending according to Embodiment 4 of the present invention.
Figure 47:
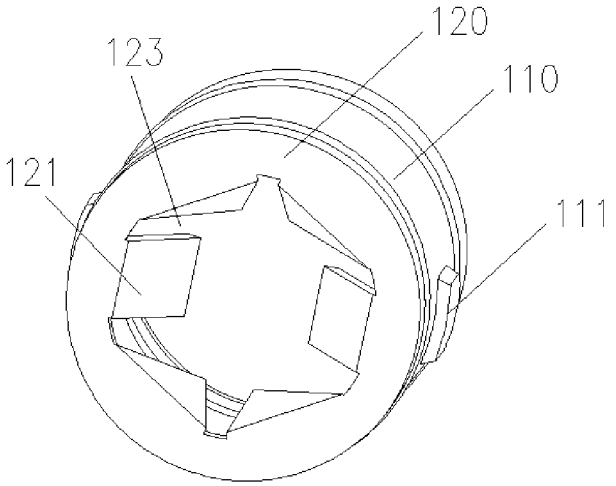
FIG. 47 is a second schematic structural view of a carrier upon bending according to Embodiment 4 of the present invention.
Figure 48:
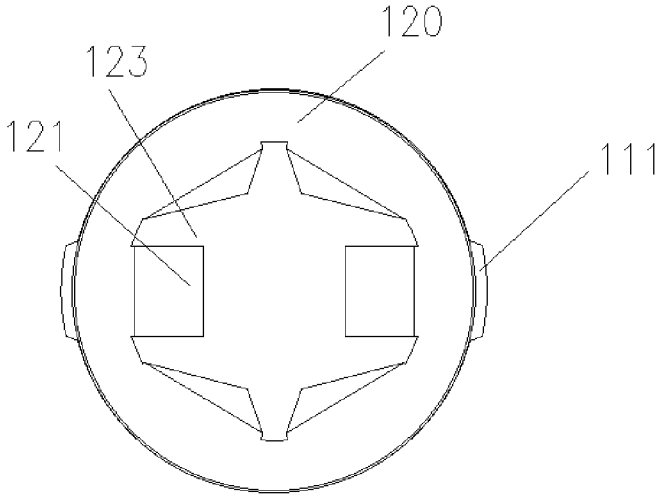
FIG. 48 is a bottom view of a carrier upon bending according to Embodiment 4 of the present invention.
Figure 49:
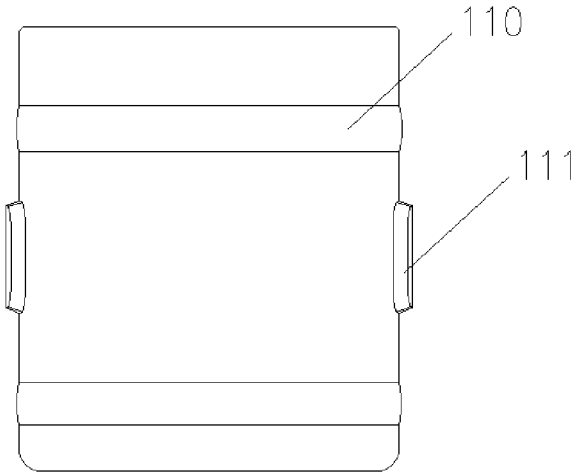
FIG. 49 is a front view of a carrier upon bending according to Embodiment 4 of the present invention.

Embodiment 3: The embodiment differs from Embodiment 1 in a shape of the punched hole. As shown in FIG. 39, the punched hole 123 is formed by connecting two concave shapes. FIGS. 27-32 are a schematic view of the carrier upon punching in the embodiment. FIGS. 33-38 are a schematic view of the carrier after the tab 121 is bent in the embodiment. In the embodiment, as shown in FIG. 37, two pairs of axisymmetric tabs 121 are provided on the bottom plate 120.

Figure 50:
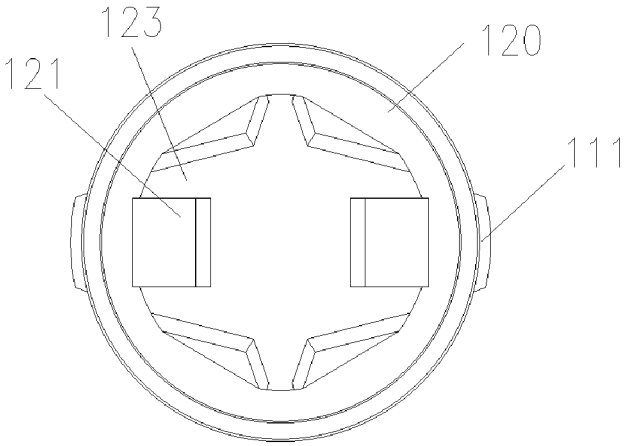
FIG. 50 is a top view of a carrier upon bending according to Embodiment 4 of the present invention.
Figure 51:
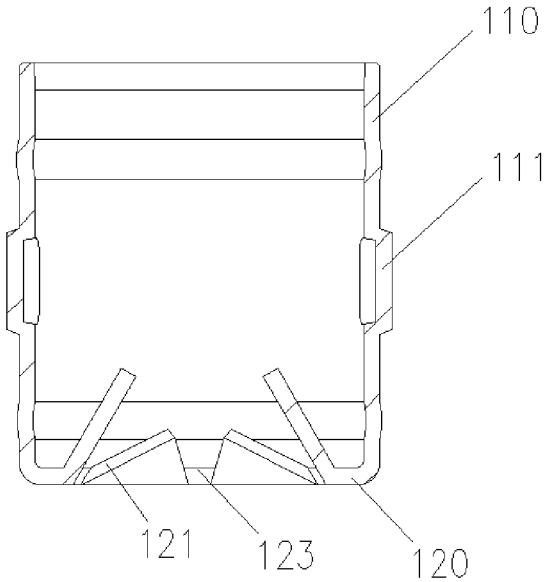
FIG. 51 is a sectional view of a carrier upon bending according to Embodiment 4 of the present invention.

Embodiment 4: The embodiment differs from Embodiment 1 in a shape of the punched hole. As shown in FIG. 52, the punched hole 123 is formed by connecting two crisscross shapes. FIGS. 40-45 are a schematic view of the carrier upon punching in the embodiment. FIGS. 46-51 are a schematic view of the carrier after the tab 121 is bent in the embodiment. In the embodiment, as shown in FIG. 50, three pairs of axisymmetric tabs 121 are provided on the bottom plate 120.

Figure 53:
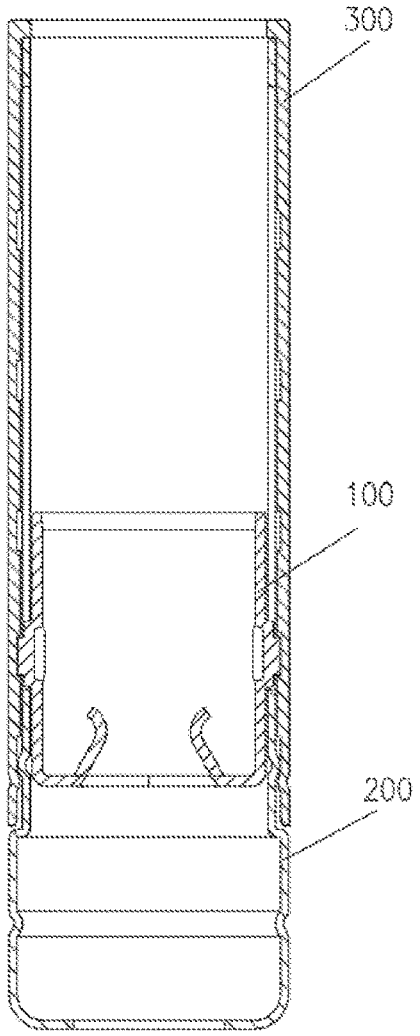
FIG. 53 is a first schematic structural view of a cartridge core assembly according to the present invention.
Figure 54:
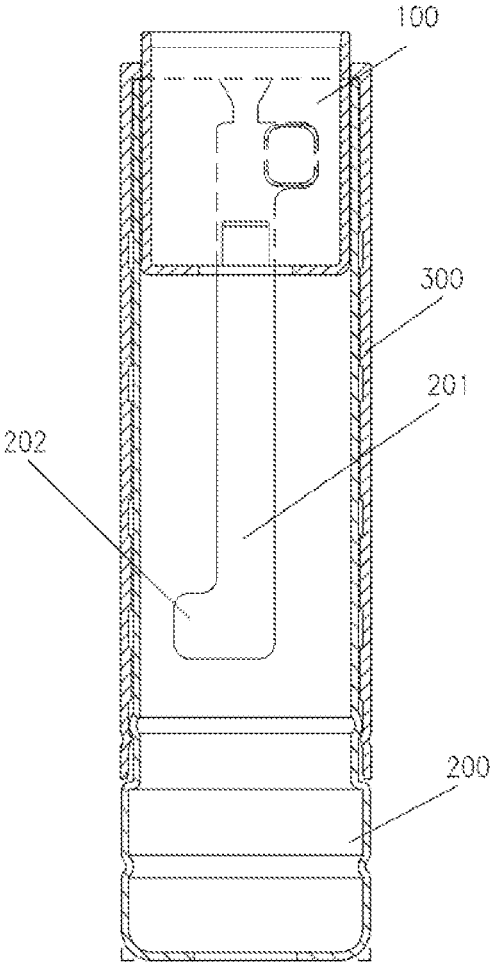
FIG. 54 is a second schematic structural view of a cartridge core assembly according to the present invention.
Figure 55:
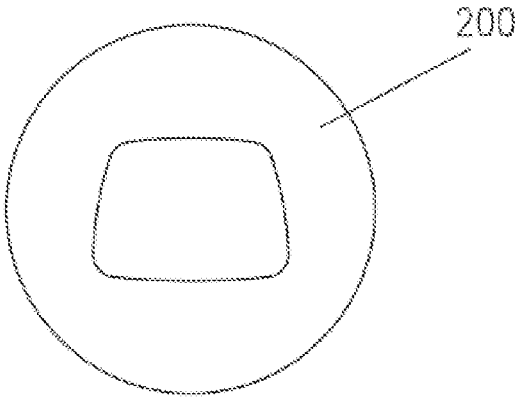
FIG. 55 is a bottom view of a cartridge core assembly according to the present invention.

As shown in FIGS. 53-55, a cartridge core assembly includes the carrier 100, rotatable cylindrical portion 200, and spiral portion 300. The spiral portion 300 is sleeved on the rotatable cylindrical portion 200. The rotatable cylindrical portion 200 is sleeved on the carrier 100. A screw thread is provided on an inner side of the spiral portion 300. Guide groove 201 is formed in the rotatable cylindrical portion 200 along an axial direction. The lug 111 passes through the guide groove 201 and cooperates with the screw thread. When rotating relative to the rotatable cylindrical portion 200, the spiral portion 300 can drive the carrier 100 to move along the axial direction, such that the cosmetic material extends out of the cartridge core assembly or retracts back to the cartridge core assembly. The cartridge core assembly uses the carrier 100 in Embodiment 1. The carrier 100 is configured to carry the cosmetic material. In view of environmental protection, the carrier 100, the rotatable cylindrical portion 20 and the spiral portion 300 are formed by punching and cutting a metal sheet material. The metal material includes copper, iron, aluminum, etc. Optionally, the carrier 100, the rotatable cylindrical portion 20 and the spiral portion 300 are formed by punching an aluminum sheet material. When the carrier 100 is machined, the lug 111 on the tube body 110 is formed by deformation of the tube body. For example, the lug 111 is formed by punching the sidewall of the tube body 110 outward along the radial direction of the tube body 110. Optionally, two axisymmetric lugs 111 are formed on the sidewall of the tube body 110. Accordingly, two guide grooves 201 are formed in the rotatable cylindrical portion 200, and two screw threads are provided on the spiral portion 300, so as to improve an operational stability of the carrier 100. The lug 111 passes through the guide groove 201. The guide groove 201 limits rotation of the carrier 100, such that the carrier 100 slides axially along the guide groove 201 to realize extension or retraction of the cosmetic material.

In an embodiment, bent positioning grooves 202 are respectively formed at two ends of the guide groove 201. When the carrier 100 operates to an extreme position, the lug 111 is located in the positioning groove 202. As shown in FIG. 54, the positioning grooves 202 are respectively formed at upper and lower ends of the guide groove 201. The positioning grooves 202 are arranged along a circumferential direction of the rotatable cylindrical portion 200. When the carrier 100 operates to an uppermost end, the lug 111 is inserted into the upper positioning groove 202. As shown in FIG. 53, when the carrier 100 operates to a lowest end, the lug 111 is inserted into the lower positioning groove 202. That is, with the positioning groove 202, the carrier 100 can stay at a highest or lowest position.

It should be noted that those of ordinary skill in the art can further make variations and improvements without departing from the conception of the present invention. These variations and improvements all fall within the protection scope of the present invention. Therefore, the protection scope of this application shall be subject to the appended claims.

What is claimed is:

1. A cosmetic material carrier, comprising a tube body and a bottom plate fixedly connected to the tube body, wherein a lug protruding outward along a radial direction is provided on a sidewall of the tube body; and a tab for fixing a cosmetic material is provided on the bottom plate, wherein the tab is formed by bending after punching and cutting the bottom plate, wherein a punched hole is formed by punching and cutting the bottom plate, and the tab is formed at an edge of the punched hole, and wherein M tabs are provided on the bottom plate, and a distance between two adjacent tabs of the M tabs is identical, wherein $M \geq 1$, and M is an odd number; or, N pairs of tabs are provided on the bottom plate, and each pair of tabs of the N pairs of tabs are arranged symmetrically along the axial center of the tube body, wherein $N \geq 1$, and N is an integer.

2. The cosmetic material carrier according to claim 1, wherein the tube body comprises an upper open end and a lower open end, and the bottom plate is fixedly provided at the lower open end, or the bottom plate is fixedly provided in the tube body between the upper open end and the lower open end.

3. The cosmetic material carrier according to claim 2, wherein the tab comprises a first end and a second end, wherein the first end of the tab is connected to the bottom plate, the second end of the tab is a free end, and the second end of the tab extends toward the upper open end and/or the lower open end.

4. The cosmetic material carrier according to claim 2, wherein a first end of the tab is narrower than a second end of the tab.

5. The cosmetic material carrier according to claim 3, wherein the tab is inclined relative to an axial center of the tube body.

6. The cosmetic material carrier according to claim 5, wherein the second end of the tab forms a bending portion toward the sidewall of the tube body or toward the axial center of the tube body.

7. The cosmetic material carrier according to claim 1, wherein the cosmetic material carrier is an integrally formed metal piece, and the lug is formed by punching the sidewall of the tube body outward along the radial direction.

8. A cartridge core assembly, comprising the cosmetic material carrier according to claim 1, a rotatable cylindrical portion, and a spiral portion, wherein the spiral portion is sleeved on the rotatable cylindrical portion, the rotatable cylindrical portion is sleeved on the cosmetic material carrier, a screw thread is provided on an inner side of the spiral portion, a guide groove is formed in the rotatable cylindrical portion along an axial direction, the lug passes through the guide groove and cooperates with the screw thread, and when rotating relative to the rotatable cylindrical portion, the spiral portion drives the cosmetic material carrier to move along the axial direction.

9. The cartridge core assembly according to claim 8, wherein the tube body comprises an upper open end and a lower open end, and the bottom plate is fixedly provided at the lower open end, or the bottom plate is fixedly provided in the tube body between the upper open end and the lower open end.

10. The cartridge core assembly according to claim 9, wherein the tab comprises a first end and a second end, wherein the first end of the tab is connected to the bottom plate, the second end of the tab is a free end, and the second end of the tab extends toward the upper open end and/or the lower open end.

11. The cartridge core assembly according to claim 9, wherein a first end of the tab is narrower than a second end of the tab.

12. The cartridge core assembly according to claim 10, wherein the tab is inclined relative to an axial center of the tube body.

* * * * *